US009638007B2

(12) United States Patent
Bouligny et al.

(10) Patent No.: US 9,638,007 B2
(45) **Date of Patent: *May 2, 2017**

(54) ELEVATOR GRIP ASSURANCE

(71) Applicant: Frank's International, LLC, Houston, TX (US)

(72) Inventors: Vernon Bouligny, New Iberia, LA (US); Phillip M. Theriot, Lafayette, LA (US); Reese Comeaux, Carencro, LA (US)

(73) Assignee: Frank's International, LLC, Houston, TX (US)

( * ) Notice: Subject to any disclaimer, the term of this patent is extended or adjusted under 35 U.S.C. 154(b) by 395 days.

This patent is subject to a terminal disclaimer.

(21) Appl. No.: 14/263,781

(22) Filed: Apr. 28, 2014

(65) Prior Publication Data

US 2014/0224470 A1 Aug. 14, 2014

Related U.S. Application Data

(63) Continuation of application No. 13/036,610, filed on Feb. 28, 2011, now Pat. No. 8,733,454.

(60) Provisional application No. 61/309,202, filed on Mar. 1, 2010.

(51) Int. Cl.

| | |
|---|---|
| ***E21B 40/00*** | (2006.01) |
| ***E21B 19/07*** | (2006.01) |
| ***E21B 19/16*** | (2006.01) |
| ***E21B 44/00*** | (2006.01) |
| ***E21B 41/00*** | (2006.01) |

(52) U.S. Cl.
CPC ..... *E21B 40/00* (2013.01); *E21B 19/07* (2013.01); *E21B 19/16* (2013.01); *E21B 41/0021* (2013.01); *E21B 44/00* (2013.01)

(58) Field of Classification Search
CPC ..... E21B 40/00; E21B 41/0021; E21B 19/07; E21B 19/16; E21B 44/00
See application file for complete search history.

(56) References Cited

U.S. PATENT DOCUMENTS 4,361,940 A * 12/1982 McFadden ..... E21B 19/07 175/423
4,616,321 A * 10/1986 Chan ..... E21B 45/00 702/9

(Continued)

OTHER PUBLICATIONS

International Search Report and Written Opinion, PCT/US11/026476, Apr. 19, 2011, 7 pages.

(Continued)

*Primary Examiner* — Blake Michener
(74) *Attorney, Agent, or Firm* — Winstead PC

(57) ABSTRACT

An interlock device for connection within a load path of a tubular support device to lock the tubular support device in a closed position in response to detecting a load suspended from the tubular support device. The interlock device includes a first member moveably connected to a second member and a biasing mechanism operationally connected to the first member and the second member providing a load setting resisting movement of the first member and the second member relative to one another. The first and the second member may be rotationally locked with one another to transmit rotation across the interlock device to the elevator.

10 Claims, 9 Drawing Sheets

(56) References Cited

U.S. PATENT DOCUMENTS 4,625,796 A * 12/1986 Boyadjieff ..... E21B 19/20 166/77.52
4,676,312 A 6/1987 Mosing et al.
5,791,410 A 8/1998 Castille et al.
5,909,768 A 6/1999 Castille et al.
6,386,282 B1 * 5/2002 Jansch ..... E21B 19/07 166/382
6,626,238 B2 * 9/2003 Hooper ..... E21B 44/00 166/66
6,742,596 B2 6/2004 Haugen
6,938,697 B2 9/2005 Haugen
6,968,895 B2 * 11/2005 Mosing ..... E21B 41/0021 166/66
7,086,461 B2 * 8/2006 Schulze-Beckinghausen ..... E21B 19/07 166/77.53
7,182,133 B2 2/2007 Webre et al.
7,281,587 B2 10/2007 Haugen
7,370,707 B2 5/2008 McDaniel et al.
7,434,614 B2 * 10/2008 Nelson ..... E21B 19/06 166/379
8,136,603 B2 * 3/2012 Schneider ..... E21B 19/10 166/380
8,251,151 B2 * 8/2012 Haugen ..... E21B 19/00 166/250.01
8,356,675 B2 * 1/2013 Pietras ..... E21B 19/16 166/380
2004/0069500 A1 * 4/2004 Haugen ..... E21B 19/00 166/380
2004/0173358 A1 * 9/2004 Haugen ..... E21B 19/00 166/380
2004/0188098 A1 * 9/2004 Schulze-Beckinghausen ..... E21B 19/07 166/380
2005/0051324 A1 * 3/2005 Mosing ..... E21B 41/0021 166/66
2005/0051343 A1 * 3/2005 Pietras ..... E21B 19/06 166/380
2005/0257933 A1 * 11/2005 Pietras ..... E21B 19/07 166/380
2005/0269105 A1 * 12/2005 Pietras ..... E21B 19/06 166/379
2006/0169461 A1 * 8/2006 Haugen ..... E21B 19/00 166/380
2008/0060818 A1 3/2008 Bourgeois et al.
2008/0264648 A1 10/2008 Pietras et al.
2009/0272542 A1 11/2009 Begnaud et al.
2009/0274545 A1 11/2009 Liess et al.
2009/0314496 A1 12/2009 Begnaud et al.
2011/0017474 A1 1/2011 Pietras et al.

OTHER PUBLICATIONS

Extended European Search Report issued Oct. 1, 2015 in EP Appl. No. 11751143.6 (PCT/US2011026476).

* cited by examiner

ELEVATOR GRIP ASSURANCE

BACKGROUND

This section provides background information to facilitate a better understanding of the various aspects of the disclosure. It should be understood that the statements in this section of this document are to be read in this light, and not as admissions of prior art.

Tubular strings are inserted into and pulled from wellbores (e.g., boreholes) at various times during the life of a well for various purposes. For example, tubular strings (e.g., drill pipe) are assembled and run into the well for drilling the wellbore, to line the wellbore (e.g., casing, liners, screens, etc.), and to position tools (e.g., tubing, etc.) in the wellbore.

A rig is typically employed to assemble the tubular string for insertion into the wellbore and to dissemble the tubular string as it is pulled from the wellbore. Generally, a rig floor mounted support device, e.g., a gripping spider, supports a first tubular (e.g., casing) that extends into the wellbore. A single joint elevator may be utilized to hoist the add-on tubular segment and align it with the first tubular. The add-on tubular segment is then connected (e.g., made-up) to the first tubular to form a tubular string. Threaded tubulars may be made-up by various tools including, but not limited to, power tongs, spinners, and top drives. A vertically movable support device, e.g., string elevator, top drive quill, or tubular running device, engages the add-on tubular to support the tubular string. The floor mounted support device, e.g., spider, then disengages the tubular string and the tubular string is lowered therethrough to a desired position. The floor mounted support device, e.g., spider, then re-engages the tubular string and the vertically movable tubular support device, e.g., string elevator, disengages the tubular string. The sequence may be reversed when pulling the tubular string from the wellbore and disassembling the tubular string.

Various safety systems have been utilized to ensure or promote assurance that at least one of the floor mounted tubular support device and a vertically moveable tubular support device (e.g., elevator) is in engagement with a tubular segment before the other tubular support device is permitted to release its load supporting engagement of the tubular. For example, interlock systems such as the grip assurance systems disclosed in U.S. Pat. Nos. 4,676,312, 5,791,410 and 5,909,763, which are incorporated herein by reference, have been provided to ensure that at least one tubular support device is engaged with the tubular string before the other tubular support device is disengaged from the tubular. However, heretofore an interlock system has not been provided that prevents opening a tubular support device in response to sensing a load acting on the tubular support device.

SUMMARY

According to one or more aspects, an interlock device for connection within a load path of an assured tubular support device includes a first member moveably connected to a second member, a biasing mechanism operationally connected to the first member and the second member providing a load setting resisting movement of the first member and the second member relative to one another, and a sensor to detect movement of the first member and the second member relative to one another. The sensor is operationally connectable to the assured tubular support device to lock the assured tubular support device in a closed position in response to detecting the movement of the first member and the second member relative to one another. The first and the second member may be rotationally locked together.

An elevator grip assurance system includes an interlock device connected in a vertical load path between a top drive and an assured tubular support device. An example of an interlock device includes a first member connected with a second member, whereby the first and the second members are longitudinally moveable relative to one another and rotationally locked together to rotate in unison, a fluid passage extending longitudinally through the interlock device to permit fluid communication between the top drive and the suspended tubular, a load setting urging the first member and the second member to an unloaded position and a sensor that locks the assured tubular support device in a closed position in response to a tubular being suspended from the assured tubular support device.

In another example, an interlock device includes a first member to connect to one of the top drive and the assured tubular support device, the first member having a piston cylinder portion; a second member to connect to the other of the top drive and the assured tubular support device, the second member having a piston head moveably disposed in the piston cylinder portion; a fluid passage extending longitudinally through the first and second members to provide fluid communication from the top drive through the interlock device, and a sensor to detect movement of the first member and the second member out of an unloaded position relative to one another and in response to lock the assured tubular support device in a closed position.

The foregoing has outlined some of the features and technical advantages of the invention in order that the detailed description of the invention that follows may be better understood. Additional features and advantages of the invention will be described hereinafter which form the subject of the claims of the invention.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
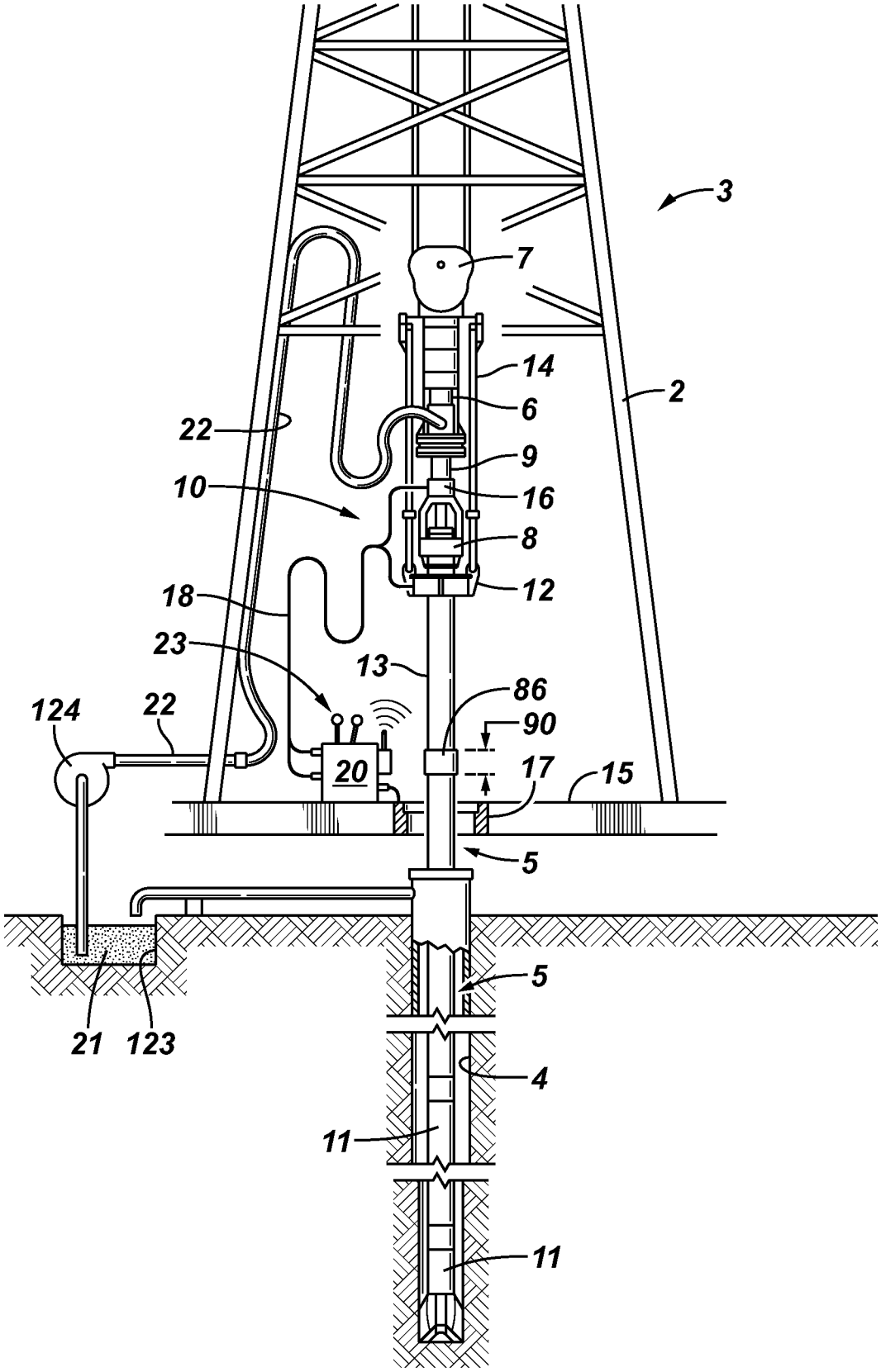
FIG. 1 is a schematic view of an example of a wellbore tubular running system incorporating an elevator grip assurance system according to one or more aspects of the disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as the top point and the total depth of the well as the lowest point, wherein the well (e.g., wellbore, borehole) is vertical, horizontal or slanted relative to the surface. The terms "pipe," "tubular," "tubular member," "casing," "liner," tubing," "drill pipe," "drill string" and other like terms can be used interchangeably. The terms may be used in combination with "joint" to mean a single unitary length; a "stand" to mean one or more, and typically two or three, interconnected joints; or a "string" meaning two or more interconnected joints.

In this disclosure, "fluidicly coupled" or "fluidicly connected" and similar terms, may be used to describe bodies that are connected in such a way that fluid pressure may be transmitted between and/or among the connected items. The term "in fluid communication" is used to describe bodies that are connected in such a way that fluid can flow between and/or among the connected items. It is noted that fluidicly coupled may include certain arrangements where fluid may not flow between the items, but the fluid pressure may nonetheless be transmitted. Thus, fluid communication is a subset of fluidicly coupled. As will be understood with the description below, fluidic, fluidicly and similar terms may comprise electrical power and electrically powered devices.

FIG. 1 is a schematic view of an example of a wellbore tubular running system 3 incorporating an elevator grip assurance system, generally denoted by the numeral 10, according to one or more aspects. FIG. 1 depicts a structure 2 (e.g., rig, drilling rig, etc.) positioned over a wellbore 4 in which a tubular string 5 is deployed. Depicted system 3 includes a top drive 6 suspended from a hoisting device 7, depicted as a traveling block, for vertical movement relative to wellbore 4. In FIG. 1, a tubular support device 8 (e.g., string elevator, tubular running device or tool) is connected to top drive 6 via quill 9 (e.g., spindle, drive shaft) which includes a bore for disposing fluid (e.g., drilling fluid, mud) into tubular string 5. Depicted tubular support device 8 may be configured to transmit rotation and torque from top drive 6 to the tubular.

Tubular string 5 comprises a plurality of interconnected tubular segments each generally denoted by the numeral 11. The upper most or top tubular segment is referred to as an add-on tubular 13. The lower end (e.g., pin end, distal end relative to hoisting device 7) of add-on tubular 13 is depicted disposed with the top end 86 (e.g., box end) of the top tubular segment of tubular string 5 which extends above rig floor 15. Tubular string 5 is disposed through a support device 17 (e.g., spider slip assembly, spider, collar load support assembly) disposed at floor 15. Spider 17 is operable to a closed position to grip and suspend tubular string 5 in wellbore 4 for example while add-on tubular 13 is being connected to or disconnected from tubular string 5.

An additional tubular support device 12, also referred to as an elevator (e.g., single joint elevator), is depicted in FIG. 1 suspended from bails 14 which may be suspended, for example, from traveling block 7 and/or top drive 6, for example, the bails, or link arms, may be actuated to a non-vertical position to pick up add-on tubular 13 from a V-door of the rig. The tubular support device 12 depicted in FIG. 1 is provided to illustrate one example of an elevator for transporting add-on tubular 13 to and from general alignment with wellbore 4, for example, to threadedly connect add-on tubular 13 to tubular string 5 or disconnecting add-on tubular 13 from the tubular string.

Figure 6:
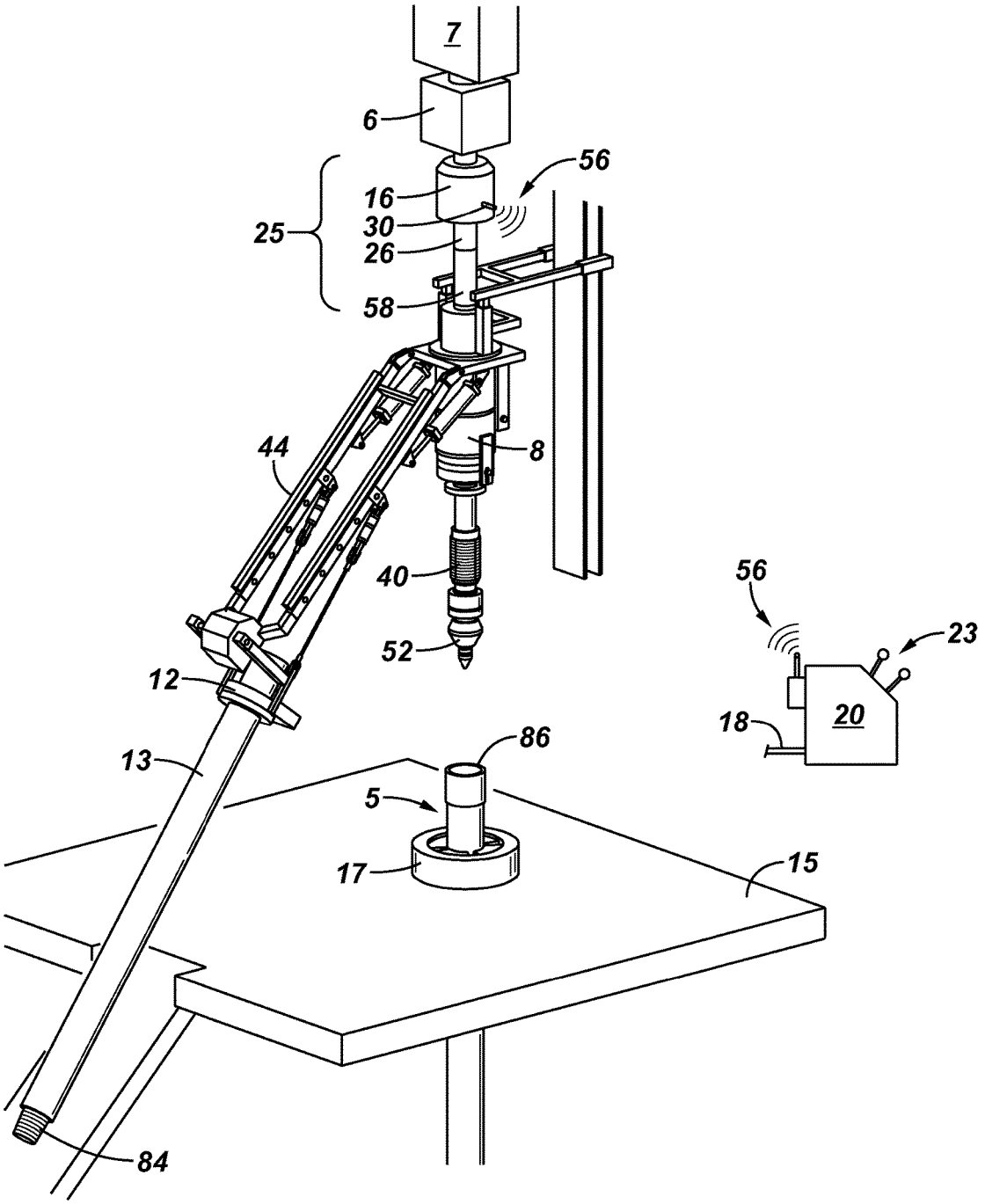
FIG. 6 illustrates an interlock device operationally connected in the load path between a top drive and a tubular running device type of assured tubular support device.

As used herein, tubular support device and tools, elevator, elevator slips, and elevator devices and tools, generally mean an apparatus or mechanism that is arranged to support a tubular for the purpose of raising or lowering the tubular. The elevator may grip the tubular radially (e.g., slip type) and/or suspend the tubular on a shoulder. Examples include external gripping and/or slip devices, such as illustrated in FIG. 1, as well as internal tubular gripping devices, such as illustrated in FIG. 6, that are often used with top drive systems. The tubular support device, or elevator, may be configured to apply torque or rotation to the supported tubular, for example to connect or disconnect tubular joints and for the purpose of drilling by rotating a tubular string. Spider or spider slips refer to a device for gripping and supporting the tubular string while the device remains substantially stationary. Often the spider is supported by the rig floor or deck.

Tubular support devices 8, 12, and spider 17 are depicted as being powered and/or controlled between their open and closed positions via pressurized fluid (e.g., gas, liquid) and/or electricity, via control (e.g., power) line 18 (e.g., umbilical, conduit). For purposes of description, open is used herein to mean that the tubular support device is actuated to a position disengaged from and not supporting the tubular. Closed is used herein to mean that the tubular support device is operated so as to support the weight of the suspended tubular. These terms apply to both external and internal tubular support devices. The tubular support devices are typically manually operated between the open and closed positions from a common location, generally referred to herein as a controller 20 or control console.

Elevator grip assurance system 10 assures that the vertically moveable tubular support device 8, 12 (e.g., elevator, tubular running device) is in effect locked in the closed position when it is supporting a tubular (e.g., add-on tubular 13, tubular string 5), thereby preventing accidental operation of the tubular support device to the open position and dropping the tubular. According to one or more aspects, elevator grip assurance system 10 blocks operational communication to the closed tubular support device in response to a load suspended from the device. For example, elevator grip assurance system 10 includes an interlock device 16 that is connected within the load path of the grip assured tubular support device 8 in FIG. 1. In this example, interlock device 16 is positioned below traveling block 7 and top drive 6 and above assured tubular support device 8 to detect a load suspended from tubular support device 8. Interlock device 16 may block operational communication to tubular support device 8 in response to detecting a load associated with the weight of add-on tubular 13 suspended from tubular support device 8, thereby preventing operation of tubular support device 8 to the open position. Operational communication (e.g., control) of the grip assured tubular support device, e.g. elevator, may be blocked in various manners, including electronic blocking for example at controller 20; physical blocking of movement of control elements 23 (e.g., levers, buttons, etc.) at controller 20 (see for example, US 2009/0272542 which is incorporated herein by reference); and/or blocking of communication through control line 18. As will be understood by those skilled in the art with reference to this disclosure, interlock device 16 may be physically positioned (e.g., connected, attached) at various locations within a tubular running system as demonstrated by example of the embodiments depicted and described in this disclosure.

FIG. 1 depicts fluid 21 (e.g., drilling fluid, mud, cement, liquid, gas) provided to tubular string 5 via mud line 22. Mud line 22 is generically depicted extending from a reservoir 123 (e.g., tank, pit) of fluid 21 via pump 124 and into tubular string 5 via tubular support device 8 (e.g., fluidic connector, fill-up device, etc.). Fluid 21 may be introduced to add-on tubular 13 and tubular string 5 in various manners including through a bore extending from top drive 6 and the devices intervening, e.g. interlock device 16, the connection of the top drive to add-on tubular 13. Rotary swivel unions may be utilized to provide fluid connections for fluidic power and/or control lines 18 and/or mud line 22. Swivel unions may be adapted so that the inner member rotates for example through a connection to the rotating quill. Swivel unions may be obtained from various sources including Dynamic Sealing Technologies located at Andover, Minn., USA. Swivel unions may be used in one or more locations to provide relative movement between and/or across a device in addition to providing a mechanism for attaching and or routing fluidic line and/or electric lines.

Figure 2:
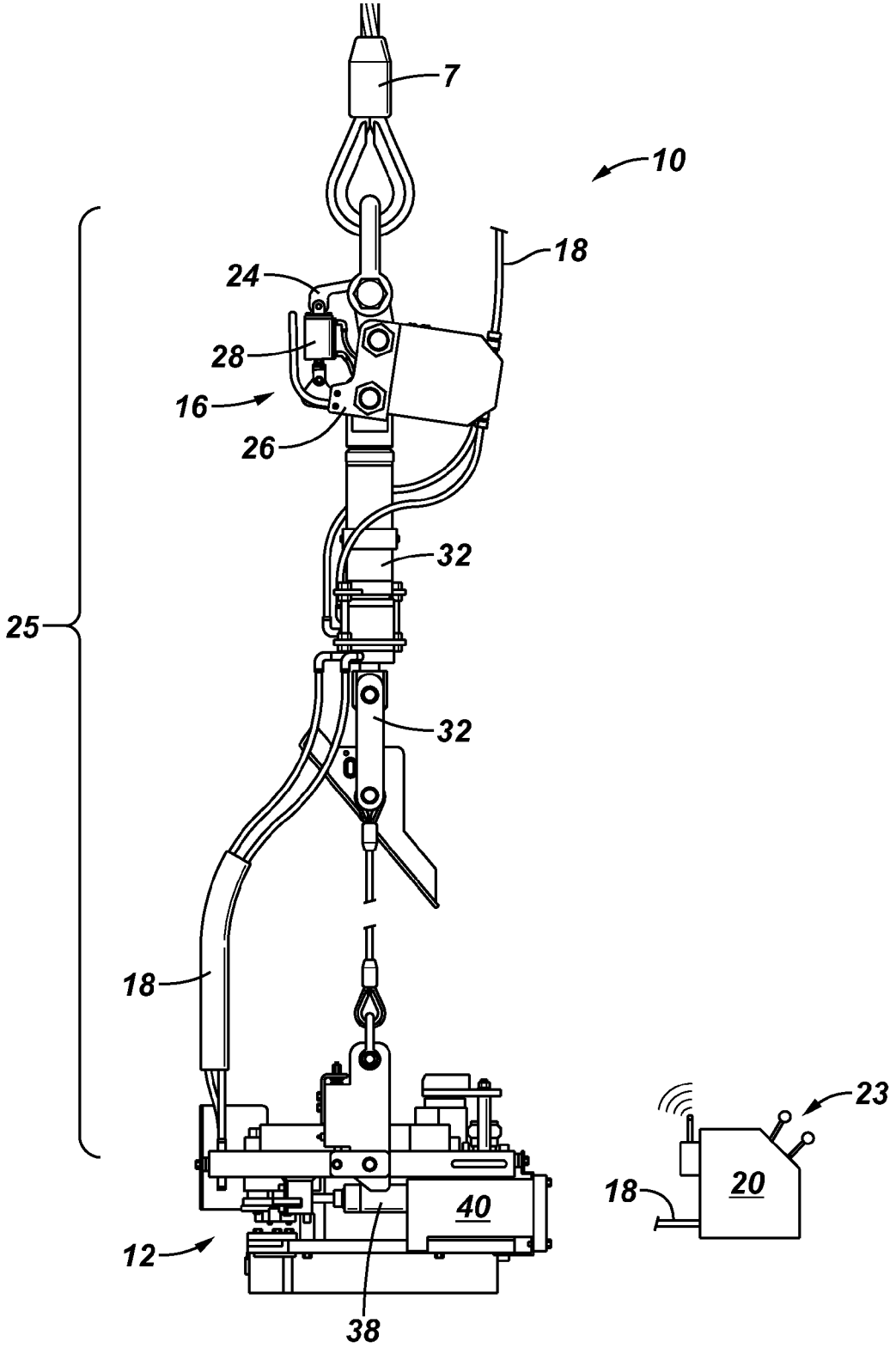
FIG. 2 is an elevation view of a grip assurance system illustrating an interlock device in an unloaded position.
Figure 2A:
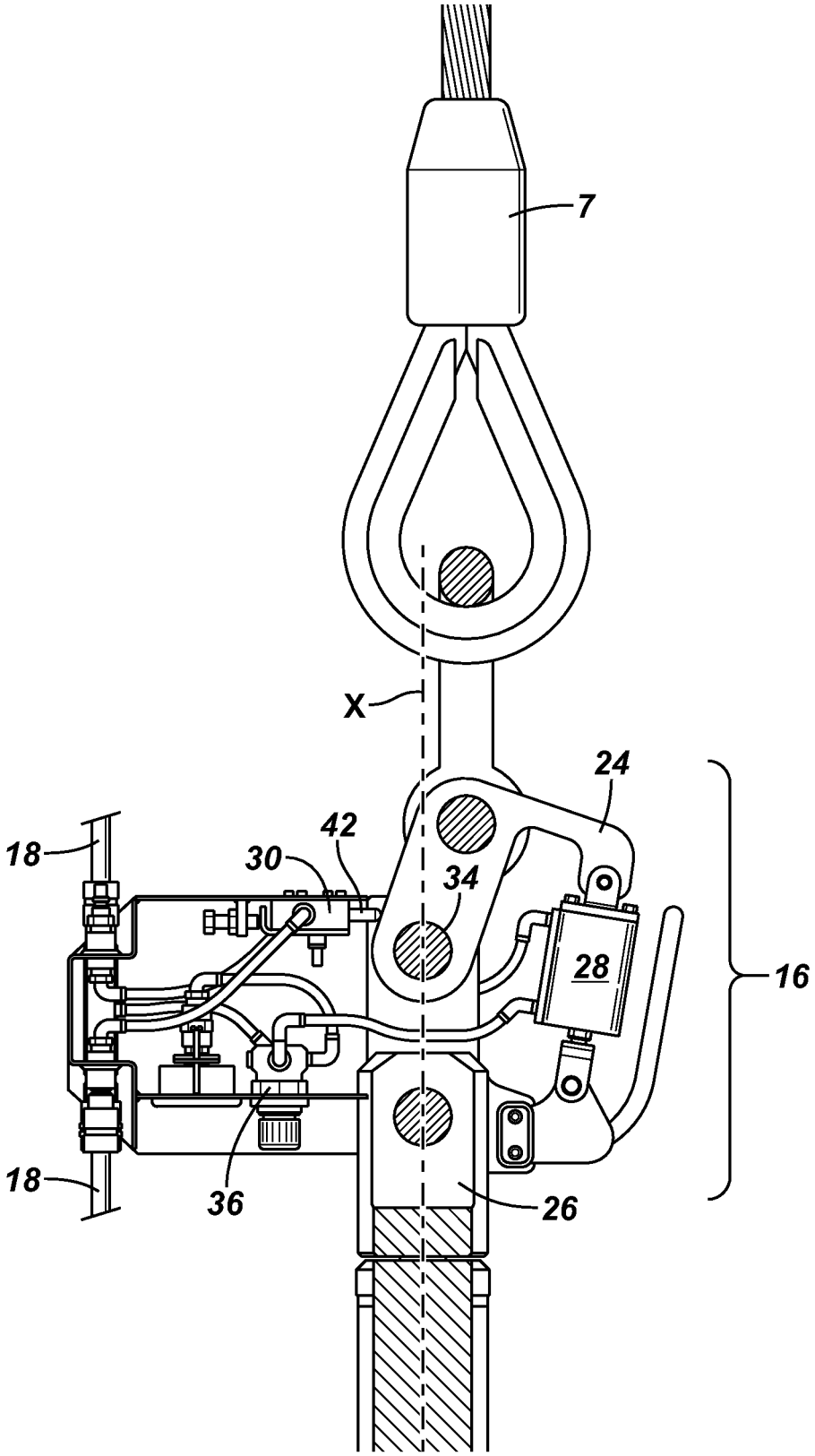
FIGS. 2A, 3A are expanded sectional views of the interlock devices depicted in FIGS. 2 and 3 respectively.

FIG. 2 is an elevation view of elevator grip assurance system 10 depicting an interlock device 16 in an unloaded position. FIG. 2A is an expanded, sectional view of interlock device 16 of FIG. 2 in the unloaded position. The assured tubular support device 12 is depicted in FIGS. 2, 2A as a single joint elevator ("SJE") suspended from a hoisting device 7, which is generally depicted to represent one or more devices from which assured tubular support device 12 may be suspended (e.g., drawworks, winch, sheave, traveling block, top drive, etc.).

With reference in particular to FIGS. 2 and 2A, the depicted interlock device 16 includes a first member 24 moveably connected with a second member 26, a biasing device 28, and a sensor 30. First and second members 24, 26 are adapted to connect within the load path of the assured tubular support device in a tubular running system (e.g., FIG. 1). For example, in FIG. 2, first member 24 is depicted attached to hoisting device 7 and assured tubular support device 12 is depicted attached to, and suspended from, second member 26 by members generally referred to as tethers 32. Tethers 32 may include one or more elements (e.g., wire rope, lift line, slings, bails, links, cables, etc.) sufficient to suspend and support tubular support device 12 and add-on tubular 13. For the purpose of describing various aspects, the load path, generally denoted by the numeral 25, extends from assured tubular support device 12 to hoisting device 7 and includes hoisting device 7, tether 32, and interlock device 16 in the depicted example.

In the embodiment depicted in FIGS. 2, 2A, first member 24 and second member 26 are moveably connected to one another at a pivot point represented by pin 34. According to one or more aspects, first and second members 24, 26 are also interconnected by a biasing device 28 which biases interlock device 16 to the depicted unloaded position thereby compensating for the weight of the elements in the load path below interlock device 16. Biasing device 28 is depicted in FIGS. 2, 2A as a fluidic (e.g., pneumatic, hydraulic) cylinder, however, it will be understood by those skilled in the art with benefit of this disclosure that other devices, including without limitation, springs and/or rotary actuators may be utilized. Biasing device 28 includes a regulator 36 which is in fluid communication with the control line 18. Regulator 36 can be utilized to set the load setting at which interlock device 16 responds to a load suspended from tubular support device 12. For example, when the load suspended from the assured tubular support device exceeds the load setting of biasing device 28, first member 24 and second member 26 can move relative to one another providing the stimulus for sensor 30 to lock the assured tubular support device in the closed position.

In the unloaded or unlocked position, a load or weight is not suspended from the assured tubular support device that exceeds the load setting of biasing device 28. Thus, interlock device 16 and/or the assured tubular support device may be referred to as being in the unlocked position.

Figure 3:
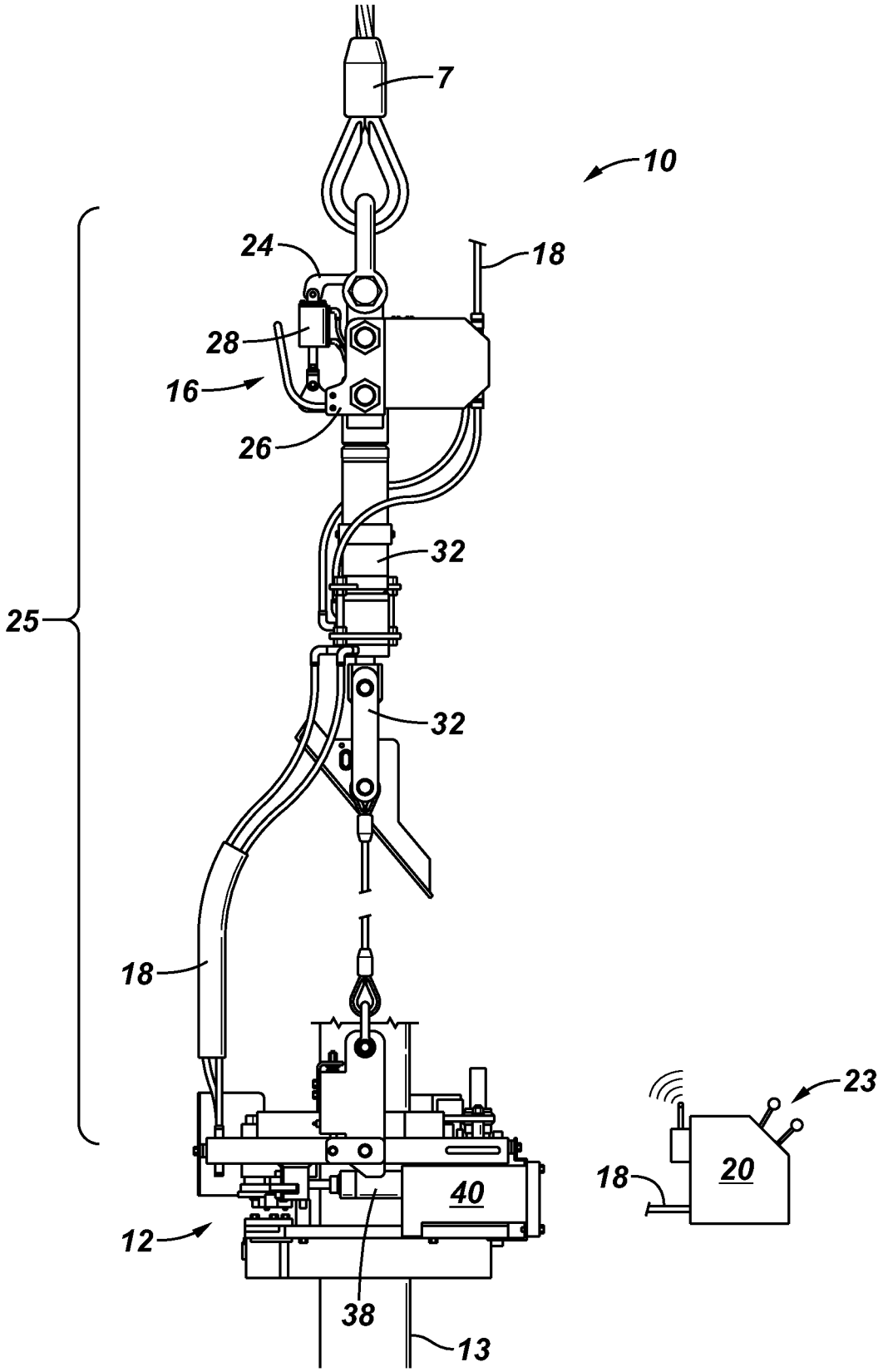
FIG. 3 is an elevation view of the grip assurance system of FIG. 2 illustrating the interlock device in a loaded position and the assured elevator in the locked closed position.
Figure 3A:
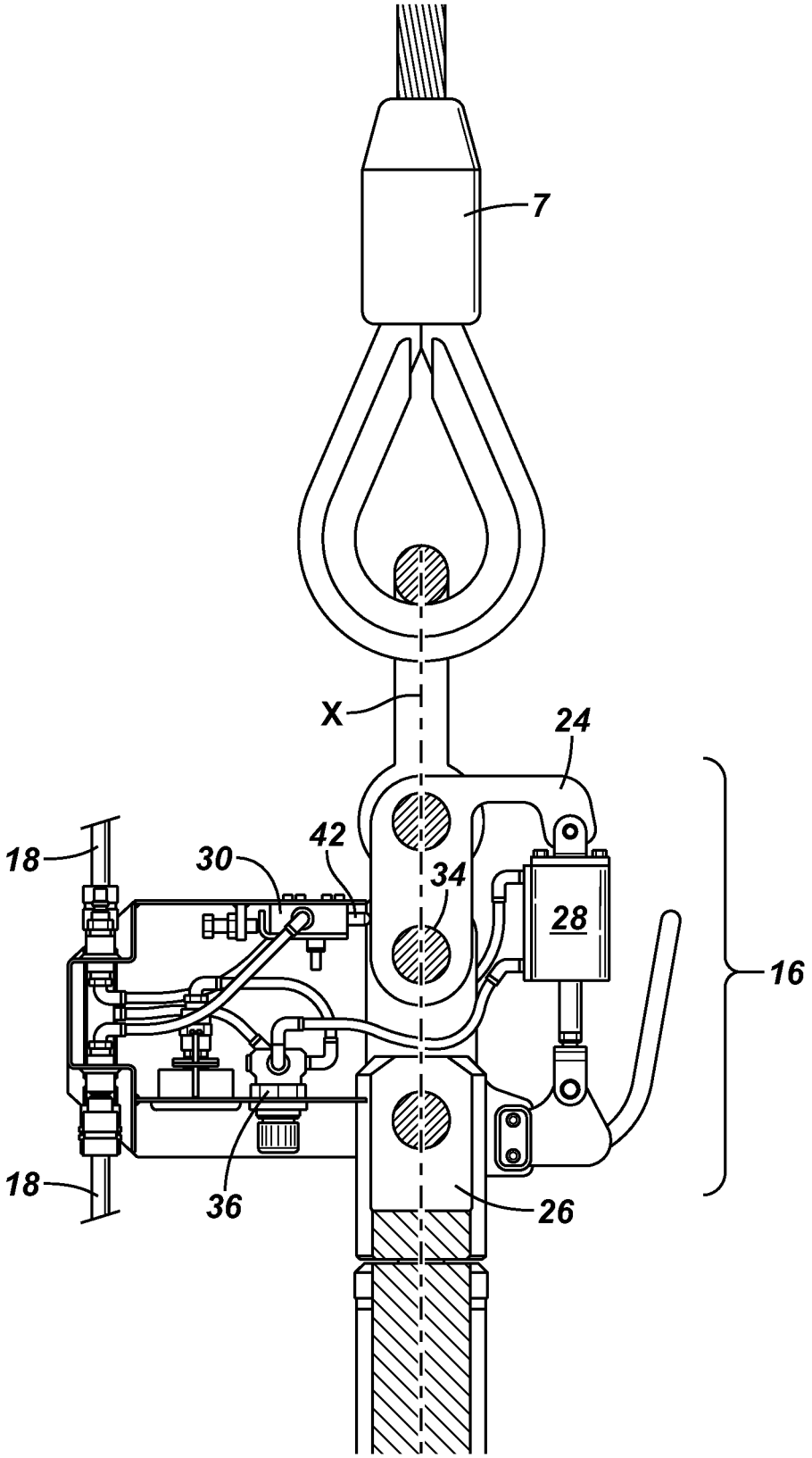

FIG. 3 is an elevation view of the elevator grip assurance system 10 depicting interlock device 16 in the loaded position (e.g., locked position), locking the assured tubular support device 12 in the closed position. FIG. 3A is an expanded, sectional view of interlock device 16 of FIG. 3 in the loaded position. Add-on tubular 13 is shown suspended from assured tubular support device 12 which is in the closed position. For example, in the depicted embodiment, fluidic power is transmitted to actuator 38 (e.g., cylinder) through control line 18 to actuate power member(s) 40 (e.g., jaws, slips, doors and/or other actuated members) to the closed position. In the closed position, tubular support device 12 supports the weight of add-on tubular 13.

In the loaded position, the weight suspended from assured tubular support device 12 (e.g., add-on tubular 13) exceeds the load setting of biasing, or compensation, device 28 allowing first member 24 and second member 26 to move relative to one another to the loaded position as shown in FIGS. 3, 3A. Sensor 30 (e.g., mechanical switch, proximity switch, pressure transducer, valve, optical sensors, magnetic sensors, etc.) detects the suspended load in excess of the load setting of interlock device 16 and in response operational communication is blocked to tubular support device 12 thereby preventing actuation of tubular support device 12 to the open position releasing support of add-on tubular 13. In the depicted embodiment, sensor 30 is a valve (e.g., solenoid) that is actuated upon contact of one of the first member 24 or the second members 26 against the valve's actuator 42 (e.g., button, plunger) blocking communication of operational power (e.g., pneumatic, hydraulic, electricity) through control line 18 and across interlock device 16 to tubular support device 12. It will be understood by those skilled in the art with benefit of this disclosure, in particular with reference to the additional figures, that sensor 30 may communicate a wireless signal, for example to controller 20, associated with the load suspended from tubular support device 12.

When the load suspended from assured tubular support device 12 is reduced below the load setting of biasing device 28 and regulator 36, biasing device 28 actuates first and second members 24, 26 to move relative to one another to the unloaded position wherein sensor 30 actuates to permit operational communication to assured tubular support device 12 across interlock device 16. As will be understood by those skilled in the art with benefit of the disclosure, the load suspended from assured tubular support device 12 will be reduced, for example, upon connection to tubular string 5 (FIGS. 1, 4, 6) and transfer of the weight of add-on tubular 13 and tubular string 5 to spider 17 (FIGS. 1, 6). In some embodiments, the load suspended from tubular support device 12 may be reduced upon transfer of support of add-on tubular 13 to another tubular support device, for example a string elevator or tubular running device.

In the examples depicted in FIGS. 2, 2A, 3, and 3A, interlock device 16 can also provide a visual indication, for personnel on the rig, that a load is suspended from tubular support device 12 and that the weight has not been transferred to another tubular support device. The visual indicator can serve as an additional and/or backup safety measure. For example, in the unloaded position depicted in FIGS. 2 and 2A, the first member 24 and the second member 26 are angular offset from one another such that they are not aligned parallel to one another along the vertical axis X (e.g., the gravitational axis). In the loaded position depicted in FIGS. 3, 3A, first member 24 and second member 26 are aligned with one another along, and parallel to, the vertical axis X.

Figure 4:
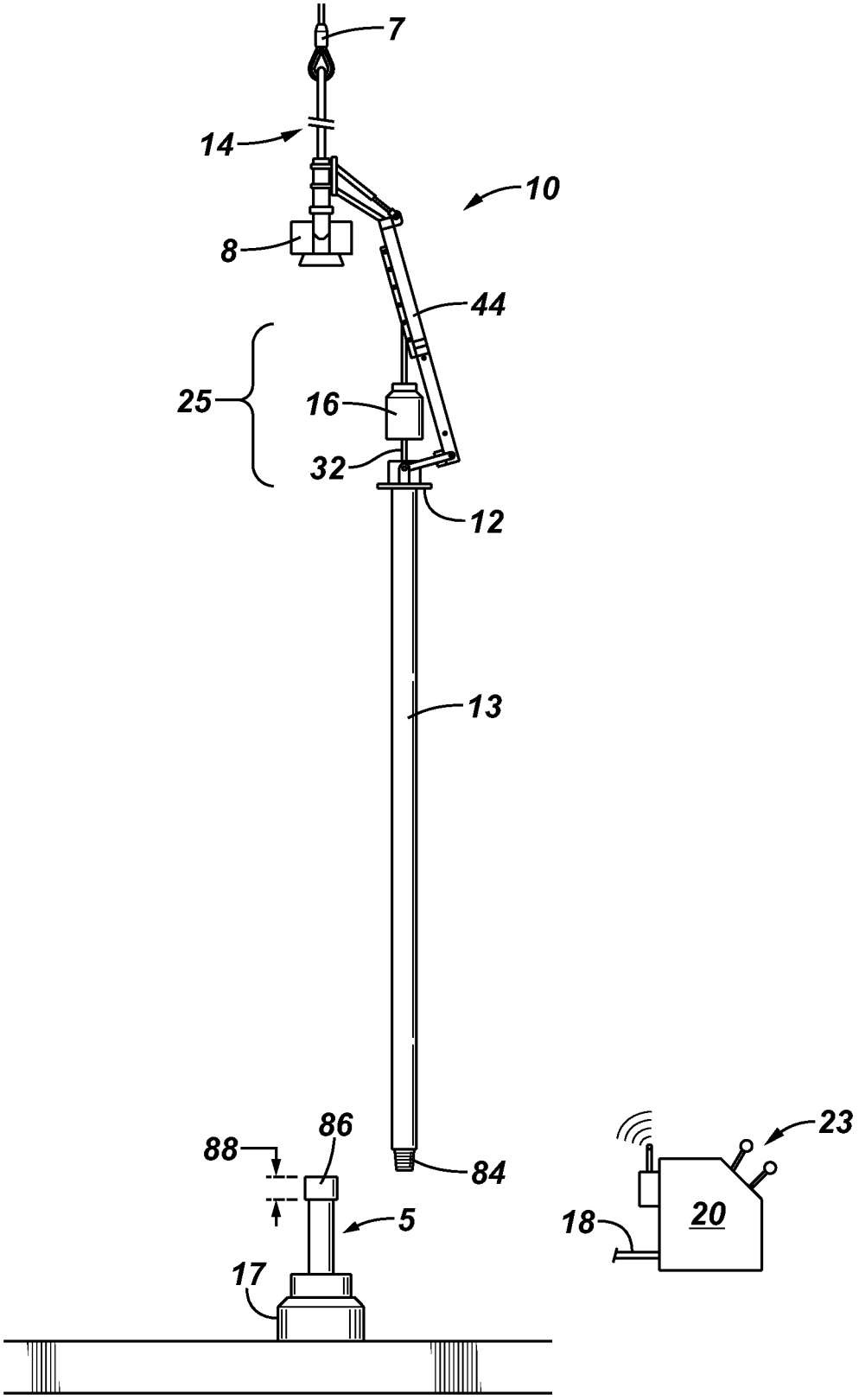
FIG. 4 is a schematic illustration of an elevator grip assurance system utilized in a tubular running system.

FIG. 4 is a schematic illustration of an elevator grip assurance system 10 utilized in a tubular running system. This example depicts interlock device 16 connected within the load path 25 of an assured tubular support device 12 (e.g., single joint pick-up elevator) that is supported by a manipulator arm 44. Manipulator arm 44 can be actuated to move add-on tubular 13, for example, between a staging area and a position vertically aligned with tubular string 5. Tubular support device 12 may be raised and lowered (e.g., vertically moved) via the connection to hoisting device 7 through bails 14 in this example. An example of a pipe manipulator arm 44 is disclosed in US 2008/0060818, which is incorporated herein by reference. This example further discloses a second tubular support device 8 (e.g., string elevator) suspended from bails 14.

Figure 5:
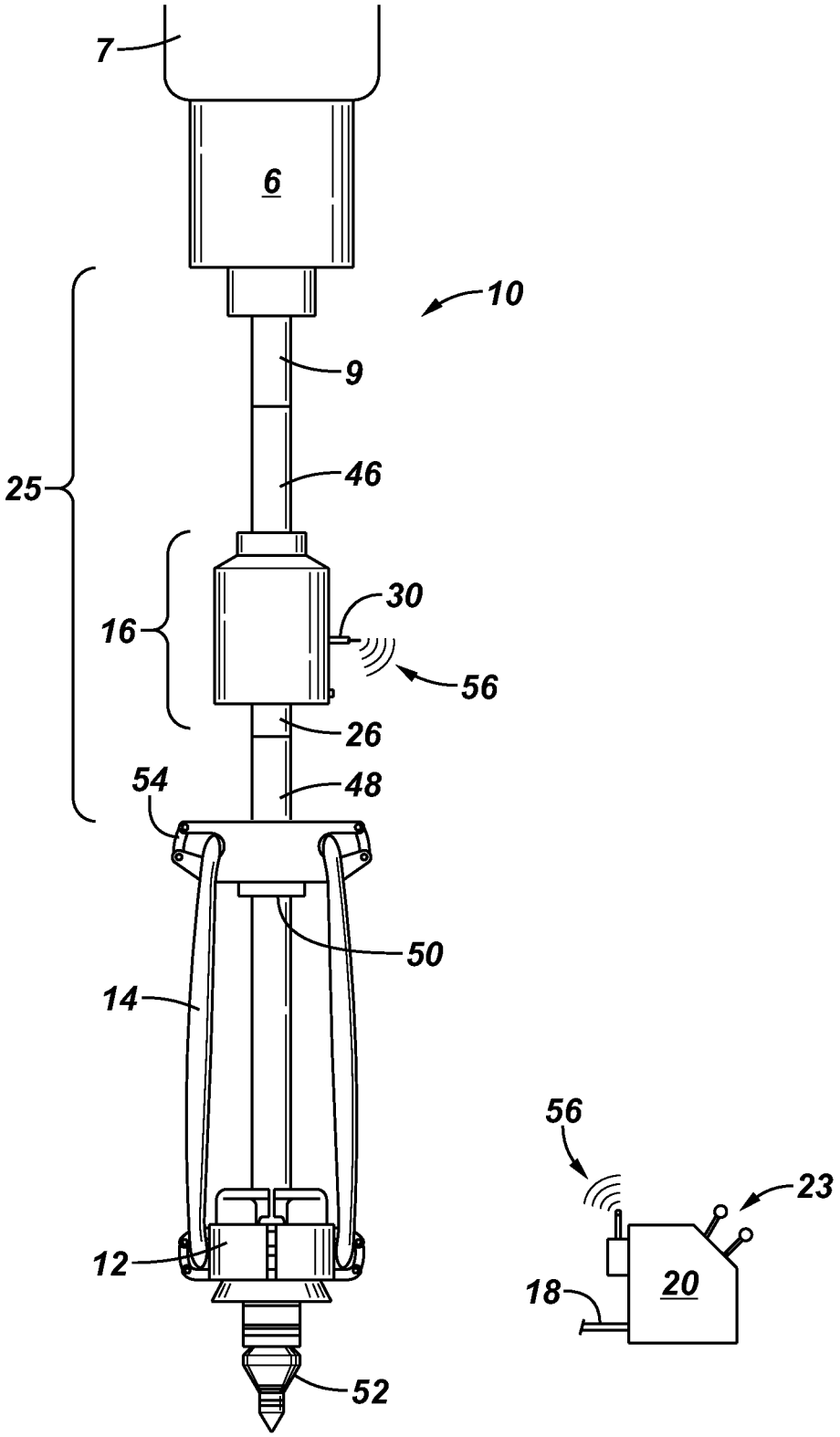
FIG. 5 is an elevation view of an interlock device operationally connected in the load path between a top drive and an elevator type of assured tubular support device.

FIG. 5 is an elevation view of another embodiment of an elevator grip assurance system 10 and interlock device 16. FIG. 5 depicts interlock device 16 connected within a load path 25 of an assured tubular support device 12. In the depicted embodiment, interlock device 16 (see FIGS. 7A, 7B) is connected to quill 9, for example via a sub saver 46, of top drive 6 (e.g., hoisting device). A sub 48 with a shoulder 50 is connected below interlock device 16. In this embodiment, a mud tool 52 (e.g., fill-up tool) is connected at the bottom end of sub 48. Tubular support device 12 is suspended by bails 14 from a hanger 54 that is attached to sub 48 at shoulder 50. In this example, hanger 54 is a shoulder type elevator that is installed upside down. Interlock device 16 is adapted to sense a load, above a load setting, that is suspended from assured tubular support device 12 and to send a wireless signal 56, for example, to controller 20 that initiates actuation of an interlock (e.g., electronic and/or mechanical) that will prevent assured tubular support device 12 from being operated to the open position until the load suspended from tubular support device 12 is reduced below the load setting of interlock device 16. As will be understood by those skilled in the art with benefit of the present disclosure, the load setting can be adjusted to compensate for the weight of equipment suspended below interlock device 16, including the weight of the grip assured tubular support device.

FIG. 6 is an elevation view of a grip assurance system 10 utilized with a tubular running device or tool, identified as tubular support device 8. One example of a tubular running device is disclosed in US 2009/0314496, which is incorporated herein by reference. Tubular support device 8 includes a mandrel 58 operationally disposed with power members 40, e.g., gripping members, to selectively grip, and support, a tubular (e.g., add-on tubular 13 and/or tubular string 5). Hoisting device 7 provides vertical movement to tubular support device 8 and top drive 6 applies rotation and torque to tubular support device 8 and a supported tubular. In this example, mandrel 58 is operationally connected to hoisting device 7, providing vertical movement, and to top drive 6 to transfer torque and/or rotation to add-on tubular 13 to threadedly connect add-on tubular 13 to tubular string 5, to disconnect add-on tubular 13 from tubular string 5, and/or to apply rotation and torque to tubular string 5 for drilling related activities.

FIG. 6 depicts a tubular support device 12 (e.g., single joint pick-up elevator) suspended from manipulator arm 44. Tubular support device 12 is depicted supporting an add-on tubular 13 that is being moved, via manipulator arm 44, from a staging area to a vertical over tubular string 5 where the load of add-on tubular 13 is transferred to assured tubular support device 8. Pin end 84 of add-on tubular 13 is stabbed into the box end 86 of tubular string 5 and tubular support device 8 can be vertically actuated, i.e. lowered, to position power members 40 inside of add-on tubular 13 and then actuated to the closed position by radially extending power members 40 into engagement with add-on tubular 13. Sensor 30 can detect the additional load of add-on tubular 13 suspended from tubular support device 8 and in response actuate blocking of operational communication to operate tubular support device 8, in particular power members 40, to the open position.

Figure 7B:
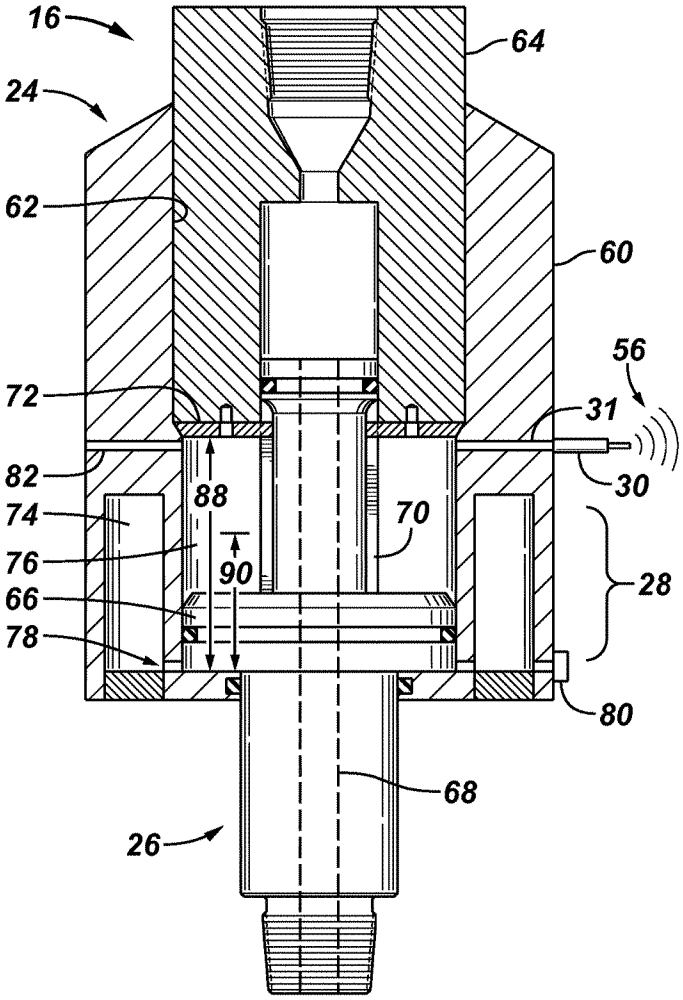
FIGS. 7A, 7B are sectional views of the interlock device illustrated in FIGS. 5 and 6 in accordance to one or more embodiments.
Figure 7A:
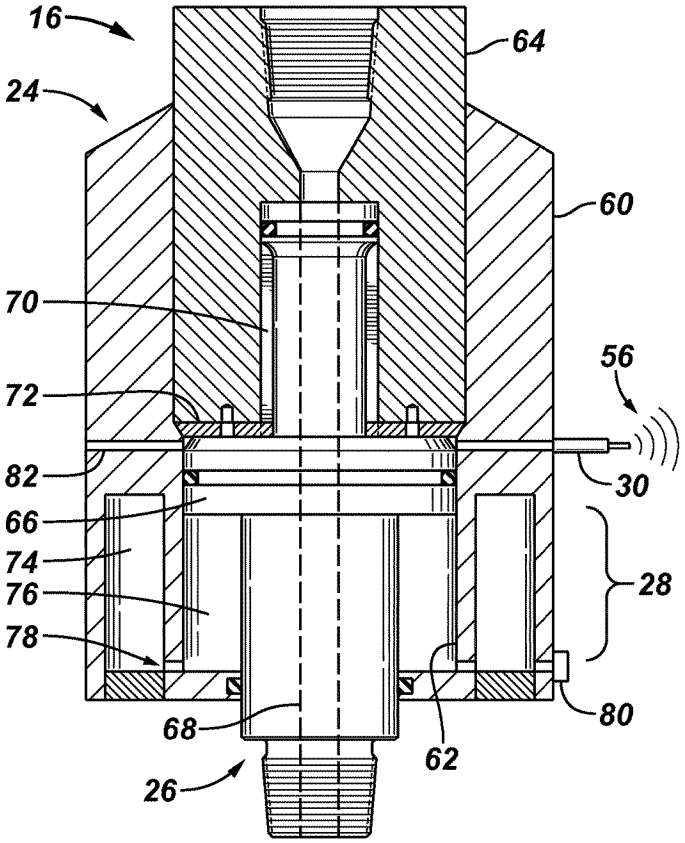

FIGS. 7A and 7B are sectional views of an embodiment of interlock device 16 as described with reference to FIGS. 5 and 6. FIG. 7A illustrates interlock device 16 in the unloaded position, associated with the grip assured tubular support device being in the open position and FIG. 7B illustrates interlock device 16 in a loaded position, associated with the grip assured tubular support device being in the locked closed position. Depicted interlock device 16 comprises a first member 24 that is moveably connected with a second member 26. In this embodiment, first member 24 comprises an outer barrel 60 forming a throughbore 62 in which a portion of the second member 26, depicted as a piston in this embodiment, is disposed and in which a gland 64 is disposed and connected (e.g., by threading). Second member 26 includes a piston head 66 disposed in throughbore 62 and moveable therein (e.g., first member 24 and second member 26 are longitudinally or axially moveable relative to one another). A fluid (e.g., drilling fluid, cement) passage 68 is formed through interlock device 16, extending in this embodiment through gland 64, second member 26 and a spline 70. Fluid passage 68 extends axially through interlock device 16 and provides fluid communication between the suspended tubular and for example top drive 6. Spline 70 is connected to piston head 66 and extends through a spline adapter plate 72 rotationally locking first member 24 and second member 26 together to transfer rotation and torque from top drive 6 (FIGS. 5, 6) through gland 64 of first member 24 to second member 26 (e.g., piston) and, for example, to the power members 40 (e.g., gripping members) of tubular running tool 8 depicted in FIG. 6.

Interlock device 16 comprises a biasing device 28 to compensate, e.g., to neutralize, a selected weight that is suspended in the load path below interlock device 16. In the depicted embodiment, biasing device 28 comprises a fluidicly pressurized (e.g., pneumatic, hydraulic) chamber 74 formed by first member 24 (e.g., outer barrel 60) that is in fluid communication with piston cylinder 76 portion of throughbore 62 through a conduit 78. A port 80 is depicted formed through the outer wall of first member 24 to connect a fluidic power source to pressurize chamber 74 and to set the load setting of interlock device 16 to neutralize a selected suspended weight. Chamber 74 of biasing device 28 may be pressurized and port 80 closed, or a fluidic power source, for example control line 18 (FIGS. 1, 5, 6), may remain connected to chamber 74, for example through a fluid swivel, allowing for adjustment of the load setting during tubular running operations.

A vent 82 is provided through first member 24 and in fluid communication with the piston cylinder 76 above piston head 66 relative to the side of piston cylinder 76 that is pressurized through chamber 74. Vent 82 is provided in this embodiment to prevent a vacuum from forming as piston head 66 moves downward in response to a force, e.g. load, acting on second member 26 in excess of the load setting of biasing device 28. As will be understood by those skilled in the art with benefit of this disclosure, the load acting on second member 26 can include the weight of the equipment as well as a force created as add-on tubular 13 is threadedly connected to tubular string 5. For example, with reference in particular to FIGS. 1, 4, and 6, add-on tubular 13 has a threaded pin end 84 for threadedly connecting to the threaded box end 86 of tubular string 5. As add-on tubular 13 is threadedly connected to tubular string 5, it advances downward toward tubular string 5 and urges the connected second member 26 downward.

According to one or more embodiments, interlock device 16 can provide for thread compensation. For example, with reference to FIGS. 7A, 7B, cylinder portion 76 provides a distance 88 through which piston head 66 moves in response to the suspended load added over the load setting and the distance associated with the thread distance 90 (FIG. 1) of the pin 84 to box 86 connection. For example, FIG. 7B depicts piston head 66 proximate the bottom end of piston cylinder 76 representing the position associated with completion of a threaded connection.

A sensor 30 (e.g., mechanical switch, proximity switch, pressure transducer, valve, optical sensors, magnetic sensors, etc.) is operationally connected to second member 26 to detect a load suspended from second member 26 in excess of the load setting of biasing device 28. In this example, sensor 30 is in communication with piston cylinder 76 through a port 31 to detect the position of second member 26 via the position of piston head 66. In this embodiment, when sensor 30 detects the presence of piston head 66 in the unloaded position (FIG. 7A) then actuation of the assured tubular support device 8, e.g. tubular running device in FIG. 6, is permitted. When a load above the load setting of biasing device 28 is suspended from second member 26, piston head 66 moves out of the unloaded position of FIG. 7A and sensor 30 responds by blocking operational communications to the assured tubular support device, thereby prevention actuation of the assured tubular support device to the open position.

A method according to one or more aspects is described with reference to all of the figures. The method includes suspending a tubular from a tubular support device, wherein the tubular support device is in a closed position supporting the tubular; detecting a load suspended from the tubular support device; and locking the tubular support device in the closed position in response to the detected load. The tubular support device may be unlocked and permitted to be operated to an open position in response to detecting the removal of the suspended load. The method may include applying rotation and torque from a top drive through the interlock device and assured tubular support device to the supported tubular.

The elevator grip assurance system 10 includes interlock device 16 connected in the load path 25 between a hoisting device and the tubular support device. In at least one embodiment, rotation is provided from a hoisting device, such as top drive, to the tubular support device. The rotation is transmitted through the load path and the interlock device 16.

According to one or more aspects, detecting the weight suspended from the assured tubular support device includes detecting movement of the first member and the second member of the interlock device relative to one another. The movement of the first member and the second member relative to one another is responsive to the suspended weight being greater than a load setting of the interlock device. The tubular support device may be locked in the closed position by blocking operational communication to the tubular support device.

The method can include threadedly connecting the tubular suspended by the assured tubular support device to a tubular string and permitting movement of the first member and the second member relative to one another a distance associated with the threading distance of the suspended tubular to the tubular string. The threaded connection may be provided by transmitting rotation from a top drive to the suspended tubular through the interlock device. Accordingly, the first and second members may be rotationally locked together and longitudinally moveable relative to one another.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An interlock device for connection within a vertical load path between a hoisting device and an assured tubular support device, the device comprising:

a first member pivotally connected to a second member at a pivot point;

a biasing mechanism connected to the first member and the second member to provide a load setting resisting pivoting movement of the first member and the second member relative to one another about the pivot point;

and a sensor to detect pivoting movement of the first member and the second member relative to one another about the pivot point, wherein the sensor is operationally connectable to the assured tubular support device to lock the assured tubular support device in a closed position in response to detecting the movement of the first member and the second member relative to one another.

2. The device of claim 1, comprising a valve to pass a power supply to the tubular support, wherein the valve closes in response to movement of the first member and the second member relative to one another.

3. The device of claim 1, further comprising a regulator connected to the biasing device to set the load setting.

4. The device of claim 1, wherein the pivot point is a member extending generally perpendicular to the vertical load path.

5. The device of claim 1, wherein the pivot point is a member extending generally perpendicular to the vertical load path; and further comprising a regulator connected to the biasing device to set the load setting.

6. An elevator grip assurance system, the system comprising:

an interlock device connected in a vertical load path between a top drive and an assured tubular support device, the interlock device comprising:

a first member comprising a cylinder portion connected with a second member comprising a piston head disposed within the cylinder, whereby the first and the second members are longitudinally moveable relative to one another and rotationally locked together to rotate in unison;

a load setting provided by fluidic pressure communicated to the cylinder portion urging the first member and the second member to an unloaded position relative to one another, wherein the fluidic pressure is communicated to the cylinder portion from a chamber disposed with the first member;

a sensor to lock the assured tubular support device in a closed position in response to a tubular suspended from the assured tubular support device; and a fluid passage extending longitudinally through the interlock device to permit fluid communication between the top drive and the suspended tubular.

7. The system of claim 6, wherein the tubular support device comprises power members that support the suspended tubular when the assured tubular support device is in the closed position.

8. The system of claim 6, wherein the tubular support device comprises power members that extend radially outward from the assured tubular support device and internally grip the suspended tubular when the assured tubular support device is in the closed position.

9. An interlock device for connection within a vertical load path between a top drive and an assured tubular support device, the device comprising:

a first member to connect to one of the top drive and the assured tubular support device, the first member comprising a piston cylinder portion;

a second member to connect to the other of the top drive and the assured tubular support device, the second member comprising a piston head moveably disposed in the piston cylinder portion;

a fluid passage extending longitudinally through the first member and the second member to provide fluid communication from the top drive through the interlock device;

the first member comprising a chamber in fluid communication with the cylinder portion, when in use the chamber communicating fluidic pressure to the cylinder portion thereby biasing the first member and the second member to the unloaded position; and a sensor to detect movement of the first member and the second member out of an unloaded position relative to one another, wherein the sensor is operationally connectable to the assured tubular support device to lock the assured tubular support device in a closed position in response to detecting the movement out of the unloaded position.

10. The device of claim 9, wherein the first member and the second member are longitudinally moveable relative to one another and rotationally locked together to rotate in unison.

* * * * *